US005141600A

United States Patent [19]

Meinecke et al.

[11] Patent Number: 5,141,600

[45] Date of Patent: Aug. 25, 1992

[54] TWIN-WIRE FORMER

[75] Inventors: Albrecht Meinecke; Rudolf Büeck; Wilfried Kraft, all of Heidenheim, Fed. Rep. of Germany; Werner Kade, Neenah, Wis.

[73] Assignee: J. M. Voith GmbH, Fed. Rep. of Germany

[21] Appl. No.: 573,048

[22] PCT Filed: May 5, 1989

[86] PCT No.: PCT/EP89/00502

§ 371 Date: Aug. 3, 1990

§ 102(e) Date: Aug. 3, 1990

[87] PCT Pub. No.: WO89/11000

PCT Pub. Date: Nov. 16, 1989

[30] Foreign Application Priority Data

May 6, 1988 [DE] Fed. Rep. of Germany ..... 3815470

[51] Int. Cl.[5] ..... D21F 9/00

[52] U.S. Cl. ..... 162/301; 162/300; 162/203

[58] Field of Search ..... 162/203, 300, 301, 352

[56] References Cited

U.S. PATENT DOCUMENTS 3,832,282 8/1974 Parker ..... 162/203
3,876,499 4/1975 Vesanto ..... 162/301
4,100,018 7/1978 Wahren et al. ..... 162/301
4,532,008 7/1985 Creagan ..... 162/301

FOREIGN PATENT DOCUMENTS

87/06637 11/1987 PCT Int'l Appl. ..... 162/301

*Primary Examiner*—Karen M. Hastings
*Attorney, Agent, or Firm*—Ostrolenk, Faber, Gerb & Soffen

[57] ABSTRACT

A twin-wire former for making a web of paper (9) having two endless loop travelling screens (11, 12) which travel over respective breast rolls (13, 14) and form a wedge-shaped feed gap of a twin-wire region. In the twin wire region the two travelling screens pass first over a curved stationary supporting device (15), then over a forming roll (16) which lies in the same screen loop (11) as the curved supporting device (15), and finally over a screen suction roll (18) which lies in the other screen loop (18). In order to form a large storage volume for water, an additional lattice-like outer shell (27) surrounded by a coarse-mesh textile filter envelope (28) is arranged on the body (16a) of the forming roll. Approximately half the periphery of the screen suction roll (18) is wrapped by the two screens (11, 12). At the end of the said wrapping zone, the one screen (11) runs off from the screen suction roll (18) followed by the other screen (12) together with the web of paper (9).

18 Claims, 3 Drawing Sheets

21
11
41
9
12
18b
18a
18
50
V
E
17
16a
31
27
16
16b
28
A
29
a
15b
46
25
47
26
15
46
25
30
45
26
15a
47
13
14
33
d
34
11
10
12

TWIN-WIRE FORMER

BACKGROUND OF THE INVENTION

The invention relates to a twin-wire former for producing a fibrous web, more particularly a paper web, and particularly to the support surface, rolls and guide means for the two wires. The invention furthermore relates to a method of manufacturing a fibrous web by means of such a twin-wire former.

A twin-wire former under the name "Bel Baie III" is already known (, Preprints "B", 74th Annual Meeting, Technical Section, Canadian Pulp and Paper Association, p. B286–B289). It has essentially the following construction. Two breast rolls guide two wire screens, called wires, from bottom to top in a substantially vertical twin-wire zone. The two wires converge to define a nip in the vicinity of a curved stationary support device which is arranged directly above one of the two breast rolls. A head box arranged below the breast rolls delivers a jet of fibrous pulp stock into the intake gap or nip formed by the two wires. A fibrous web is then formed from the jet of stock in the twin-wire zone. This is achieved in known manner by the removal of most of the water from the stock, mainly as a result of the tension of the wires and the curved course of the twin-wire zone. The curved wire guide surface of the stationary support device has openings for the removal of water, and at least some of the openings may be connected to a source of vacuum. Following the curved support device in the direction of travel of the wire, there is a forming roll, which is developed as a suction roll. The forming roll and the curved support device are located within the loop of the same wire. For removing the water which has penetrated through the meshes in the outer wire in the region of the curved support device, at least one deflector is arranged in the loop of the other wire.

The known arrangement has the following features. The forming roll and the stationary support device are located in the loop of the second wire. Furthermore, the two wires separate in the upper region of the periphery of the forming roll. As seen in the direction of web travel, the separation occurs at the run-off point of the first wire, which is located in front or upstream of the run-off point of the second wire. The second wire then travels, together with the fibrous web that has been formed, over a suction couch roll where additional water removal takes place and then travels to the customary take-off point.

The known arrangement tries to obtain the following result. The use of a stationary support device of very large radius of curvature arranged at the start of the twin-wire zone is intended to form the fibrous web as gently as possible in spite of a high speed of operation. As a result of the simultaneous removal of water to both sides of the web through both wires, the web to be formed, which is preferably a paper web, is to be imparted with properties which are as similar as possible on both sides, i.e., there is to be little two-sidedness. At the same time, the quality of the paper produced is to be improved in that upon the removal of the water, as little fibrous material and fillers are lost as possible, i.e., there is the highest possible retention.

However, problems arise in this known twin-wire former because the "second" wire comes into contact on the wrapping zone of the forming roll directly with the suction roll shell of the forming roll, which is perforated in the customary manner. This creates a danger that the perforations of the suction roll shell produce a so-called hole shadow marking in the web of paper. This reduces the quality of the finished web of paper. This danger could be reduced or avoided by forcing the water removal and the web formation in the starting region of the twin-wire zone and therefore in front or upstream of the forming roll so that the formation of the web is at least substantially concluded when the forming roll is finally reached. However, such forcing of the water removal at the stationary support device would entail the danger of reduced retention and furthermore could cause the occurrence of so-called needle holes in the web of paper, particularly in the case of relatively thin papers. Such needle holes are presumed to result from the speedy removal of the water being greater than average at individual points of the web of paper.

The known twin-wire zone is curved in only one direction, i.e., there is no countercurvature such as appears, for example, in the S- shaped twin-wire zone of FIG. 2 of U.S. Pat. No. 3,876,499. This presents a danger that there may be a certain two-sidedness of the finished web of paper, i.e. the finished web of paper may not be imparted the same properties to the desired extent on both sides.

Another disadvantage of the known twin-wire former is that the separation of the two webs takes place already in front or upstream of the suction couch roll and therefore occurs at a place where the web of paper formed still has a relatively low content of solids. As a result, a relatively large number of fibers are torn out of the paper web just formed by the second wire upon the separation from the paper web while the web is still being carried further with the first wire. This again impairs the quality of the finished paper web.

SUMMARY OF THE INVENTION

The object of the present invention is to improve the known double-wire former so that, despite the highest possible operating speed, web formation can take place even more gently than previously at the start of the twin-wire zone so as to obtain the highest possible retention and avoid the danger that needle holes might be produced in the web. At the same time, the danger of the occurrence of hole-shadow marking at the forming roll should be eliminated. Finally, upon reaching the place of separation of the two wires, the fibrous web should have a higher solids content than previously, in order thereby to counteract the danger of fibers being torn out of the fibrous web.

This object is achieved by the invention.

A twin-wire former for producing a fiber web, and particularly a paper web, has two endless loop wire screens or wires for forming the fibrous web. A pair of breast rolls, one in each wire screen loop, are positioned in the region of the exit mouth of a head box which supplies the fibrous pulp stock to be dewatered. The breast rolls define the start of the twin-wire zone in which the web is formed. Downstream of the breast rolls along the twin-wire zone there is at least one curved stationary support device within the first wire screen loop. The surface of the support device is convexly curved with respect to the wires in the twin-wire zone and the wires wrap over the stationary support device.

Within the same first wire screen loop there is a forming roll which is a short distance downstream of the stationary support device. The forming roll has a periphery and the two wire screens are wrapped over at least one-sixth and preferably over about one-fourth of the periphery of the forming roll. The forming roll is a suction roll having a suction zone around part of its circumference.

The forming roll has a perforated body through which water may be drawn by suction means communicating into the forming roll. There is a grid shaped outer shell around the outside of the perforated body. The shell is shaped to define individual cells of relatively large volume that are open in the radial direction both inward toward the perforated body and outward of the shell. The cells temporarily accumulate water. In the twin-wire zone, the two wires converge toward each other from the breast rolls toward the forming roll, and the web is formed between the breast rolls and the forming roll. In one embodiment the wires converge upwardly. In another embodiment, the wires converge horizontally, and the stationary support device is above and faces down to the upper wire in the twin-wire zone.

There may be a deflector within the loop of the second wire screen, located generally in the region of the curved support device along the twin-wire zone.

There is a suction couch roll disposed within the second wire screen loop and located downstream of the forming roll along the twin-wire zone. The suction couch roll also is a suction roll. The wire screens wrap over a circumferential suction zone of the suction roll. The two wires wrap at least one-third of the periphery of the suction couch roll and preferably as much as one-half of the periphery. Then the first wire is lifted free of the web which continues on the second wire. The web is later transferred from the second wire.

In the twin-wire former of the invention, the curved stationary support device and the forming roll are no longer arranged in the loop of the second wire but instead are in the loop of the first wire and the twin-wire zone extends in addition over the suction couch roll, to the extent that about one-half of the periphery of the suction couch roll is preferably wrapped around by both wires. Another feature of the twin-wire former of the invention is that the water storage volume of the shell of the forming roll is increased several times. As is known per se from German Patent 32 10 320, this result is obtained by arranging an additional grid-like outer shell on the perforated body of the roll, preferably in the form of a honeycomb covering.

The combination of these features with the stationary curved support device, which is still present, enables the main water-removal zone, i.e. the zone of web formation in which a part of the fiber material is still in the form of a suspension, to be extended from the curved stationary support device far into the circumferential wrapping zone at the forming roll. In other words, the water removal can take place much more slowly at the curved stationary support device than heretofore. In accordance with features of the apparatus and a method of its use, this can be controlled by varying the vacuum in the stationary support device and/or by varying the tension of the wires. This results in higher retention, and no or far fewer needle holes than previously. The formation of the web is then continued—by the smaller radius of curvature of the forming roll in the wrapping zone thereof, with substantially greater intensity than previously so that the formation of the web is completed at the latest at the end of the wrapping zone. This can again be controlled by the above-mentioned measures and furthermore by varying the vacuum in the forming roll. In this connection, the greatly increased water storage capacity of the forming roll is of importance. It not only considerably increases the water removal capacity thereof but it also completely eliminates the danger of the occurrence of hole-shadow marking in the web of paper.

Finally, the further removal of the water from the completely formed web of paper takes place in the end region of the twin-wire zone, namely at the suction couch roll. Due to the very long wrapping zone of the suction couch roll, a substantially higher solids content of the web of paper can be obtained than with the known design. Thus, far fewer fibers are torn out from the web of paper at the place of separation of the two wires than previously.

It is important to retain the features that the forming roll is arranged in the same wire loop as the stationary support device and directly behind or downstream of that device and that at least one deflector be provided for the removal of water in a compact stream in the other wire loop within the region of the stationary support device. The first of these features saves a large amount of space, particularly in view of the fact that in many cases a deflector, having a large cross-section of its carrier body, must be arranged in the other wire loop precisely at the place where the wires are to leave the stationary support device. If it were desired to locate the forming roll also in the other wire loop, it would be necessary to provide a very large spacing between the forming roll and the stationary support device so that the forming roll does not collide with the deflector. This would result in an increased requirement for space and a long, unsupported stretch of the wire, with the danger of disturbing the formation of the web.

An additional advantage of the twin-wire former of the invention results from the fact that the greatest part of the suction zone of the suction couch roll is not covered by only one wire, but rather by two wires. This substantially reduces the amount of noise developed.

Differing from the known construction, the twin-wire zone now has an S-shaped course. In this way, the danger of a certain two-sidedness in the finished web of paper is counteracted, i.e. one can assure identical properties on both sides of the web of paper.

Based on the journal "Pulp & Paper" Sept. 1982, pages 130–139, and particularly pages 133 and 136, it is recognized that a twin-wire former is known (referred to as a "papriformer") in which two suction rolls are connected one behind the other in an S-shaped double-wire zone. In that case, however, other essential features of the twin-wire former of the invention are lacking, in particular the curved stationary support device provided toward the start of the twin-wire zone, as well as the substantially increased water storage capacity, provided by the additional grid-shaped outer shell of the first suction roll, that is the forming roll.

U.S. Pat. No. 3,876,499 discloses a twin-wire former which is formed by an upper wire that is placed on a conventional Fourdrinier wire. The feeding of the stock is effected in the downward direction. In the initial zone extending in the downward direction of the double-wire zone, a stationary curved support device is arranged. Following that device, there are additional water removal elements and finally a forming roll. Behind or following that, the double-wire zone of FIG. 1 is curved in the other direction by a second forming roll arranged in the lower wire. Both forming rolls can be developed as suction rolls. Only about ⅛ of the periphery of the second forming roll is wrapped around by both wires. Behind the second forming roll, both wires travel over several suction boxes. On one of the suction boxes, the upper wire separates from the paper web which has now been formed and from the lower wire. The lower wire guides the web of paper over at least one additional suction box and over a suction couch roll to a take-off point.

The stationary support device of the above U.S. Patent has a relatively large radius of curvature and the first forming roll has a relatively small radius of curvature. This is intended to assure that the formation of the fibrous web commences as gently as possible. After this, i.e. in the region of the smaller radius of curvature, the removal of the water is then forced. According to Column 4, the solids content behind the second forming roll is "at least 1.5%". It can be concluded from this relatively low value of the solids content that a part of the fibrous material is still in the form of a suspension in the region between the two forming rolls and therefore where the curvature reverses. In other words, in that region, a part of the fibers are still floating in the water. This has a very unfavorable effect upon the further forming of the fibrous web. Another disadvantage of the known construction is that the arrangement of the aforementioned suction boxes in the manner of a traditional fourdrinier wire takes up a great deal of space.

In contrast with the invention, and in particular the above-mentioned additional grid-shaped outer shell of the forming roll, as well as the very large suction zone of the forming roll, cause the forming of the fibrous web to be concluded, at the latest, at the end of the wrapping zone of the forming roll.

Furthermore, the construction in accordance with the invention requires substantially less space. This is due, on the one hand, to the fact that the forming roll is arranged directly, i.e. at a very small distance, behind or following the stationary support device and, on the other hand, to the fact that after the completion of the formation of the web, further removal of water takes place exclusively on the suction couch roll which is wrapped by the two wires.

Further advantageous embodiments of the invention are set forth below. These advantages will be explained below by the description of two embodiments.

Figure 3:
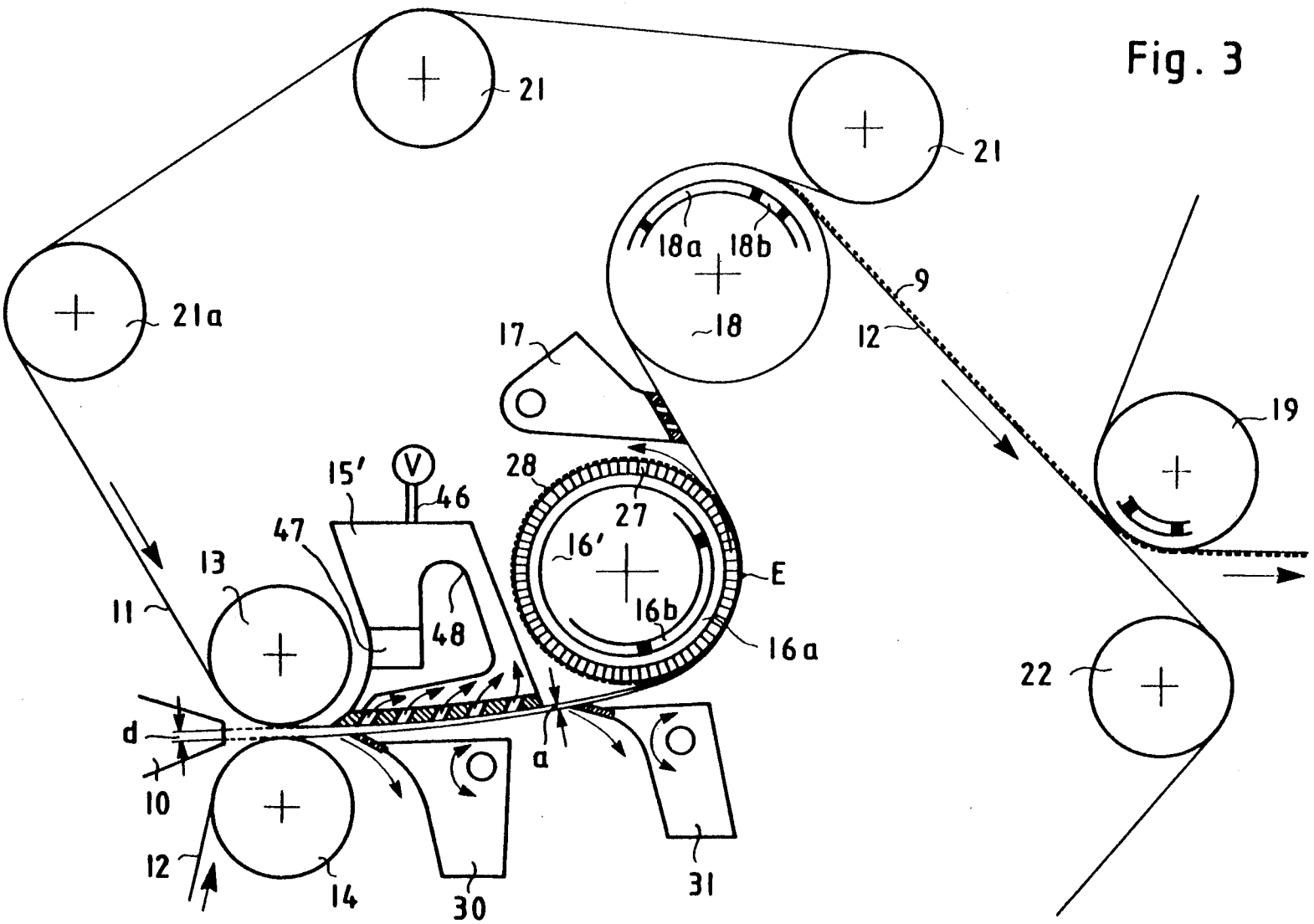

FIG. 3 diagrammatically shows a twin-wire former with a substantially horizontal web-forming zone.

DESCRIPTION OF THE PREFERRED EMBODIMENTS

Figure 1:
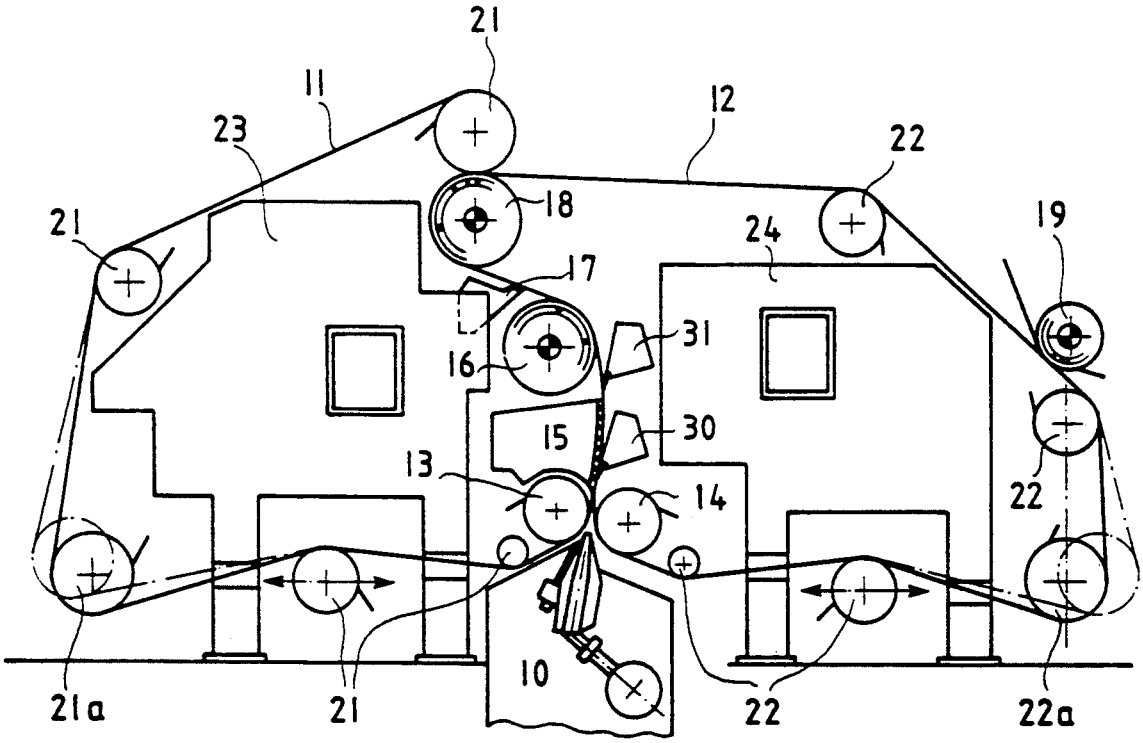
FIG. 1 shows a twin-wire former with a substantially vertical web-forming zone, shown in a diagrammatic side view.

FIG. 1 shows a head box 10, two endless loop wire screens, namely a first wire 11 and a second wire 12, each guided by respective breast roll 13 and 14 into a twin-wire zone just behind or downstream of the exit from the headbox. Within the twin-wire zone the two wires 11 and 12 first pass over a convexly curved stationary support device 15 of very large radius of curvature and directly thereafter wrap over a portion of the circumference of a forming roll 16 of relatively small radius of curvature. These two elements 15 and 16, as well as a following suction box 17 which can also be developed as a water deflector, all lie within the loop of the first wire 11. The two wires then travel over a larger portion of the circumference of a suction couch roll 18, which is contained within the loop of the second wire 12. In the vicinity of the upper vertex of this roll 18, the two wires 11 and 12 separate. The paper web is carried along by the second wire 12 up to a take-off suction roll 19 which removes the web from the second wire. The other guide rolls for the first wire 11 are 21, **21*a* and the guide rolls for the second wire 12 are 22, 22*a*. The guide rolls 21*a* and 22*a* are developed as wire-tensioning rolls for varying the tension of the respective wires. Finally, FIG. 1 shows a machine frame 23 for the first wire and a machine frame 24** for the second wire.

The twin-wire former is shown in a preferred arrangement in which the direction of flow of the head box 10 and the direction of travel of the wires 11 and 12 within the initial region of the twin-wire zone is approximately vertical from bottom to top. Other arrangements however are also possible (see FIG. 3).

Figure 2:
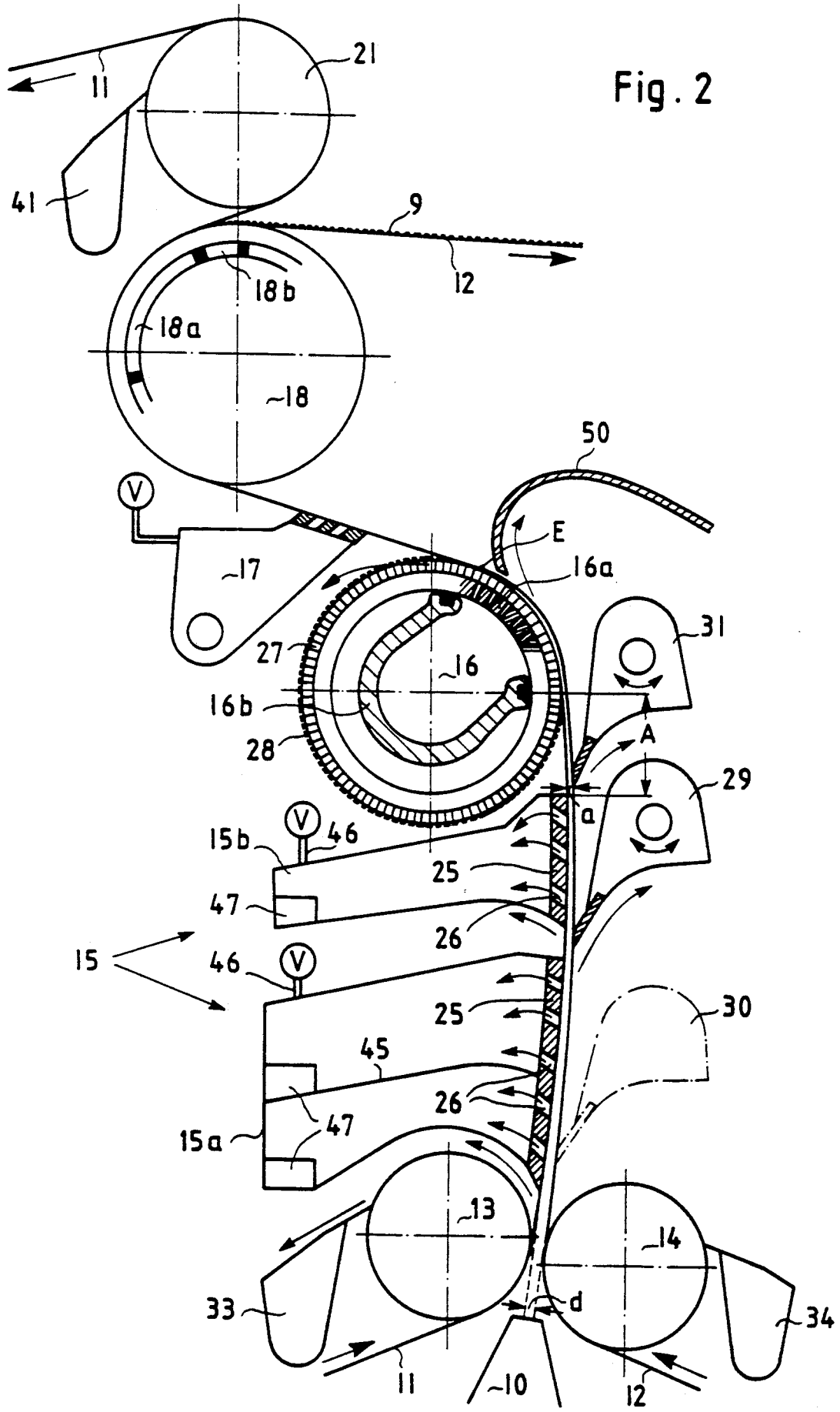
FIG. 2 shows the twin-wire zone of a twin-wire former which is similar to the twin-wire of FIG. 1, but on a larger scale.

FIG. 2 shows that the curved stationary support device 15 can be divided into two separate water-removal boxes **15*a* and 15*b*. Each of these boxes has a respective convexly curved wire-guide surface formed of different cross-machine direction slats 25. Between these slats there are slots 26 through which a part of the water is removed. The lower water-removal box 15*a* can be divided by a partition 45 into a lower region and an upper region. Only the upper region has a suction connection 46 which leads to a source of vacuum V. The upper water-removal box 15*b* is developed integrally as a suction box. Lateral water outlets 47 are provided for each water-removal box. The distance A between the upper end of the upper water-removal box 15*b* and the point where the wires 11, 12 first travel onto the forming roll 16 is relatively small. The two wires 11, 12 wrap over the forming roll 16 in a circumferential suction zone of at least one-sixth and preferably over about one-fourth of the periphery of that roll. It can also be noted from FIG. 2 that practically the entire right-hand upper quadrant of the forming roll 16 is wrapped by the two wires 11 and 12. It is shown diagrammatically that the forming roll 16 has a perforated roll body 16*a* and a suction box 16*b* in the roll body. The suction zone of the latter also extends practically over the entire right-hand upper quadrant of the forming roll. A honeycomb covering 27, which is formed of strands or of sheet metal strips standing on edge, is arranged on the outside of the roll body 16*a* of the forming roll 16. This honeycomb covering forms an additional grid-shaped outer shell which has cells of large volume open in the radial direction. In other words, these cells are open both toward the wire 11 and towards the holes in the roll body 16*a*. A fabric sleeve in the form of a coarse mesh screen fabric 28 is arranged on the surface of the honeycomb covering 27**.

In FIG. 2 the thickness "d" of the jet of stock leaving the head box 10 as well as the distance "a" between the two wires 11 and 12 (shown for instance at the outlet from the stationary support device **15*b*) have been shown exaggeratedly large. This is intended to make it clear that the two wires 11 and 12 converge towards each other not only in the region of the curved stationary support device 15 but also in the wrapping zone of the forming roll 16. This shows that the process of the formation of the web begins relatively slowly at the support device 15 and terminates only at the forming roll 16. The end of the part of the twin-wire zone, which defines the zone in which the two wires converge toward each other (and thus the end of the web-forming process), may be located, for instance, approximately in the center of the wrapping zone of the forming roll 16, as shown merely by way of example in FIG. 2**. The end of the wire convergence is indicated symbolically there by the point E. The solids content there of the web of paper has reached a value of approximately 8%.

Deflectors 29, 30, 31 serve for stripping off of water which has penetrated through the meshes of the second wire 12. A deflector 29 is located at the place where the two wires 11 and 12 travel unsupported from the lower water-removal box 15*a* to the upper box 15*b*. Another deflector 31 is arranged at the place where the two wires 11 and 12 travel unsupported from the upper water-removal box 15*b* to the water-removal and forming roll 16. Another deflector 30 can be arranged in the lower region of the lower water-removal box 15*a*. The deflectors are important in order to remove the water penetrating in the starting region of the twin-wire zone through the meshes of the second wire 12 as early as possible, so that the following removal of water through the second wire 12 can take place unimpeded. The water is removed by the deflectors in focussed form, i.e. in the form of water jets which are as compact as possible. This counteracts the tendency that at the desired very high operating speed of about 1500 meters per minute, the water emerging from the wire meshes would be sprayed to form a mist. This would not only be unpleasant for the operating personnel, but there would also be the danger of remoistening of the web of paper on its path from the wire couch roll 18 to the take-off roll 19. The deflectors 29, 30, 31 are swingably mounted and can thus be applied to the second wire 12 to a greater or lesser extent. The water thrown off in the wrapping zone of the forming roll 16 is collected and carried away by means of a baffle plate 50.

The suction couch roll 18 has at least two suction zones 18*a* and 18*b*. A first large suction zone 18*a* is located in the circumferential region around which the two wires 11 and 12 are wrapped. That region wraps at least one-third and preferably about one-half of the periphery of the suction couch roll. A smaller suction zone 18*b* in which a higher vacuum is usually suggested is located behind or downstream of the place where the first wire 11, guided by one of the screen guide rolls 21, lifts off from the paper web 9 which has been formed. The entire suction arrangement can also be divided into three suction zones. Scrapers, which remove water and possibly particles of substance from the rolls 13, 14 and 21 are designated 33, 34 and 41 in FIG. 2.

The arrangement shown in FIGS. 1 and 2 in which the wires 11, 12 travel substantially upward in the web-forming zone, is preferred for various reasons. For instance, the feeding of the stock to the head box 10 is substantially simpler than, for instance, with the arrangement in accordance with U.S. Pat. No. 3,876,499. In the region of the stationary support device 15 the removal of the water that emerges from the wires 11 and 12 takes place in an initially predominantly horizontal direction relatively uniformly toward both sides. This increases the tendency toward greater uniformity of the initial forming of the web on the two wires and thus to the uniformity of the properties of the paper on its top and bottom sides.

However, in accordance with FIG. 3, the invention can also be carried out with predominantly horizontal guidance of the wires 11', 12' in the web-forming zone. In this case, the first wire 11' can be referred to as the "upper wire" and the second wire 12' as the "lower wire". As shown, it is preferable to arrange the stationary support device 15' and the forming roll 16' within the loop of the upper wire 11' and the suction couch roll 18 within the loop of the lower wire 12' so that the wire 11 passes beneath the lower surface of the device 15'. Otherwise, after the suction couch roll 18, the web of paper 9 would hang on the bottom of the second wire 12'. The stationary support device 15' is provided with a water-raising or suction device, known per se. The wrapping zone on the forming roll 16' (and thus also the suction zone 16*b*) is somewhat larger than in FIG. 2. Otherwise however the elements of FIG. 3 are substantially the same as those of FIGS. 1 and 2 and therefore have been provided with the same reference numbers.

We claim:

1. A twin-wire former for producing a fibrous web from fibrous pulp stock, the former comprising:

a first and a second endless wire screen for forming and aiding in the dewatering of the fibrous web;

first guide means for guiding the first endless wire screen in a first wire screen loop; second guide means for guiding the second endless wire screen in a second wire screen loop; the first and second wire screen loops being guided by the respective first and second guide means therefor to have a common twin-wire zone along which the fibrous pulp stock and the web being formed therefrom is sandwiched between the wire screens;

the first guide means including a first breast roll for the first wire screen to wrap around, the first breast roll being located in the region of the mouth of a head box which supplies the fibrous pulp stock of which the web is formed, the second guide means including a second breast roll for the second wire screen to wrap around, the second breast roll also being located in the region of the mouth of the head box; the breast rolls being so placed and the wire screens being so wrapped about the breast rolls that the wire screens are caused to converge toward each other as they move over the breast rolls, and the breast rolls define the start of the twin-wire zone;

downstream of the breast rolls along the twin-wire zone, at least one curved stationary support device within the first wire screen loop, the support device is convexly curved with respect to the wires in the twin-wire zone, the first and second guide means being so placed as to cause the first and second wire screens to wrap over the convex curve of the stationary support device;

a forming roll located in the first wire screen loop a short distance downstream of the stationary support device along the twin-wire zone, the forming roll having a periphery on which the wire screens may wrap; the forming roll being so placed as to direct the first and second wire screens to pass over the convex curve of the stationary support device; the forming roll being a suction roll, including a first suction zone extending circumferentially over at least one-sixth of the periphery of the forming roll; suction means communicating with the first suction zone for applying suction thereto the first and second guide means, the forming roll and the stationary support device being so placed and shaped as to cause the first and second wire screens in the twin-wire zone to wrap over the first suction zone;

the forming roll having a perforated body through which water may be drawn by the suction means; a grid-shaped outer shell around the outside of the perforated body, the shell forming the periphery of the forming roll, the shell defining cells of relatively large volume that are open in the radial direction both inward toward the perforated body and outward of the shell for temporary accumulation of water in the cells;

a suction couch roll within the second wire screen loop, located downstream of the forming roll along the twinwire zone, the suction couch roll including a periphery which is located with respect to the forming roll for causing the wire screens to wrap over the first suction zone of the forming roll, and a partial circumferential second suction zone of at least one-third of the periphery of the suction couch roll; suction means communicating with the second suction zone for applying suction thereto; the first and second guide means and the forming roll guiding the first and second wire screens to wrap partially around the periphery of the suction couch roll over the second suction zone;

the first guide means being located as to guide the first wire screen to separate from the second wire screen and to define the end of the twin-wire zone at the suction couch roll, and the second guide means being located to guide the second wire screen to wrap further around the suction couch roll and to carry the fibrous web with it and to then separate the second wire screen from the suction couch roll.

2. The twin-wire former of claim 1, further comprising at least one deflector within the second wire screen loop and located generally in the region of the curved support device along the twin-wire zone, the deflector being placed for deflecting water from the second wire screen.

3. The twin-wire former of claim 1, wherein the forming roll, the stationary support device, the suction couch roll and the first and second guide means are so located that the circumferential zone of wrapping of the wire screens around the forming roll is about one-fourth of the periphery of the forming roll.

4. The twin-wire former of claim 1, further comprising web takeoff means spaced from the suction couch roll for taking the formed web off the second wire screen.

5. The twin-wire former of claim 4, wherein the breast rolls, the stationary support device, the forming roll, and the first and second guide means are so shaped and positioned as to cause the first and second wire screens to gradually converge toward each other along the twin-wire zone from the breast rolls.

6. The twin-wire former of claim 5, wherein the first and second wire screens are caused to converge toward each other from the breast rolls, over the support device and to the forming roll.

7. The twin-wire former of claim 5, wherein the breast rolls, the support device, the forming roll and the suction couch roll are so placed that the first and second wire screens are caused to converge toward each other along the twin-wire zone generally in an upward direction.

8. The twin-wire former of claim 5, wherein the breast rolls, the support device, the forming roll and the suction couch roll are so located that the first and second wire screens are caused to converge toward each other along the twin-wire zone generally in a horizontal direction.

9. The twin-wire former of claim 8, wherein the breast rolls, the support device and the forming roll are arrayed in a generally horizontal array, one after the other along the twin-wire zone.

10. The twin-wire former of claim 9, wherein the support device convex curve faces generally downwardly, and the first wire screen loop passes below the support device convex surface and is also above the second wire screen loop.

11. The twin-wire former of claim 10, wherein the suction couch roll, the forming roll and the first and second guide means are so placed that, in the twin-wire zone, the suction couch roll is wrapped by both of the first and second wire screens over about one-half of the periphery of the suction couch roll; the second suction zone extending around the part of the suction couch roll wrapped by both of the wire screens.

12. The twin-wire former of claim 1, wherein the suction couch roll, the forming roll and the first and second guide means are so placed that, in the twin-wire zone, the suction couch roll is wrapped by both of the first and second wire screens over about one-half of the periphery of the suction couch roll; the second suction zone extending around the part of the suction couch roll wrapped by both of the wire screens.

13. The twin-wire former of claim 1, wherein the grid-shaped outer shell of the forming roll comprises a generally honeycomb-shaped section formed of bands stood on their edges and a fabric sheathing over the honeycomb bands.

14. The twin-wire former of claim 2, wherein the deflector in the second wire screen loop is disposed in the region of the twin-wire zone where the wire screens are travelling from the support device to the forming roll.

15. The twin-wire former of claim 1, further comprising a suction box disposed in the first wire screen loop between the forming roll and the suction couch roll and arranged for deflecting water coming off the first wire screen.

16. The twin-wire former of claim 15, wherein the suction box has a front ledge upstream of the suction box in the twin-wire zone, the ledge serves as a deflector; downstream of the front ledge, the suction box including means for suctioning water from the first wire screen.

17. The twin-wire former of claim 1, wherein the stationary support device includes water discharge openings for receiving water therethrough off the first wire screen and includes suction means for supplying suction to the stationary support device for suctioning water through the water discharge openings.

18. The twin-wire former of claim 17, wherein the suction means for the stationary support device is operable for setting a vacuum at the water discharge openings of the stationary support device, the first and second guide means are operable for setting a tension of the wire screens, and the curvature of the stationary support device are all set so that only part of the web formation of the former takes place in the region of the twin-wire zone over the stationary support device; and the suction means for the forming roll sets a suction level at the first suction zone at the periphery of the forming roll such that the remaining formation of the web takes place in the first suction zone of the forming roll, whereby the formation of the web is at the latest concluded at the end of the first suction zone of the forming roll where the wire screens leave the forming roll.

* * * * *